United States Patent [19]

Devin

[11] 4,411,253

[45] Oct. 25, 1983

[54] ASH HOOD

[76] Inventor: Paul W. Devin, 31 Taine Mountain Rd., Unionville, Conn. 06085

[21] Appl. No.: 439,648

[22] Filed: Nov. 5, 1982

[51] Int. Cl.[3] ..... F23J 1/00

[52] U.S. Cl. ..... 126/242; 110/166

[58] Field of Search ..... 126/242, 243, 245; 110/167, 165 R, 170, 166

[56] References Cited

U.S. PATENT DOCUMENTS 2,445,050 7/1948 Wilhite ..... 126/242

FOREIGN PATENT DOCUMENTS 157012 of 1904 Fed. Rep. of Germany ..... 126/242

387891 5/1965 Switzerland ..... 126/245

*Primary Examiner*—Samuel Scott

*Assistant Examiner*—G. Anderson

[57] ABSTRACT

A relatively simple and inexpensive device is provided to assist in the clean and efficient removal of ash from a wood- or coal-burning stove. The device includes a duct which is so configured as to take advantage of the draft of the stove, to thereby prevent the discharge of airborne ash particulates during the cleaning operation.

7 Claims, 7 Drawing Figures

ASH HOOD

BACKGROUND OF THE INVENTION

The current popularity of wood- and coal-burning stoves for residential use has created an increased demand for means by which the ash produced can be cleanly and conveniently removed and disposed of. Ideally, such a device would be of simple and inexpensive construction, and portable to permit ready removal, so as to avoid detracting from the appearance of the stove. Units for handling ash and the like have been proposed in the past, but frequently they are too complex and/or expensive for practical use in the home, or they are simply not suited to the intended purpose.

For example, in U.S. Pat. No. 1,765,871, Johnson discloses a dust collector that is adapted for mounting upon a receptacle, into which ashes are emptied; the draft through a chimney is utilized for dust control. The device is entirely unsuited for use with a stove, and because it must be attached to a chimney it is not truly portable.

In U.S. Pat. No. 2,141,812, Fales Sr. discloses a cleanout device for an oil burning stove, which is utilized to remove accumulated soot. The device comprises a hollow cylindrical body which is adapted to embrace the outer end of the cleanout sleeve, and has a scraper member secured therewithin; it is similarly unsuited for use in removing stove ashes.

The heating plant disclosed in McIntire U.S. Pat. No. 2,209,531, incorporates an internal partition or bridge wall, to define a storage chamber for clinkers. The clinkers can be transferred with a suitable hook or poker to the storage chamber, where they can be cooled and/or removed at the convenience of the operator.

In U.S. Pat. No. 2,445,050, Wilhite discloses a clinker oven which includes a drawer that is connected to the furnace through an angled upper housing section, which is closed by an access door. The device is designed for permanent attachment to the stove, in replacement of the firing door; it is therefore not portable, and would interfere with loading of wood. Due to the limited length of the upper connecting section, moreover, the draft of the stove would not be effective to minimize the discharge of airborne ash to the living area.

Accordingly, it is a primary object of the present invention to provide a novel device for use in removing ash from a stove or the like, which device is relatively simple and inexpensive to manufacture, and is nevertheless highly effective in minimizing the amounts of fines and dust that are released during ash-removal operations.

A more specific object of the invention is to provide a portable device having the foregoing features and advantages, which utilizes the draft of the stove to substantially prevent the escape of airborne ash.

SUMMARY OF THE INVENTION

It has now been found that the foregoing and related objects of the invention are readily attained in a device which includes a duct having an open front end, that is dimensioned and configured to substantially enclose the ash-removal opening of the stove, and a back end that is open to free air flow. The bottom wall portion of the duct has an opening formed therethrough, intermediate its opposite ends, over which a displaceable door is mounted. When it is aligned generally horizontally with the stove opening and positioned thereagainst, the duct provides an extension from the stove, enabling ash to be withdrawn therefrom and guided through the bottom wall opening into an underlying container, secured to the duct by appropriate means. The natural draft of the stove will cause air to flow into the back end and to sweep across the bottom wall opening; this will prevent the discharge of any substantial amount of airborne fines or ash dust to the environs.

Generally, the bottom wall portion of the duct will be substantially planar, and the opening therethrough will be spaced at least about six inches from the back end. In more specific embodiments, the cross-sectional configuration of the duct and the opening of the stove will be generally rectangular, and preferably the back end of the duct will be entirely open. The displaceable door will advantageously comprise a plate that is mounted upon the bottom wall portion of the duct for sliding movement between a closed position disposed over the opening, and an open position displaced rearwardly therefrom.

The device may additionally include a receptacle comprised of an upwardly opening container positioned beneath the duct, and a cover, the receptacle having means for disengageable attachment to the securing means of the duct. Generally, the receptacle will be dimensioned and configured to provide underlying support for the duct, in alignment with the stove opening, thereby obviating need for other support means.

DETAILED DESCRIPTION OF THE ILLUSTRATED EMBODIMENTS

Figure 1:
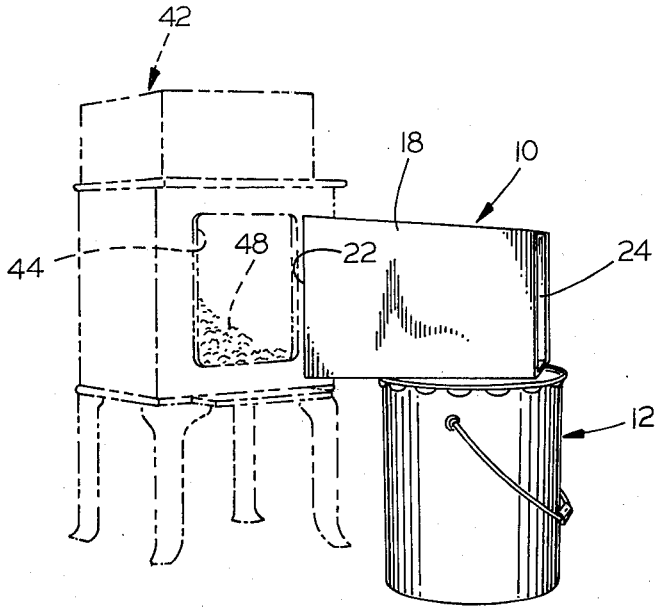
FIG. 1 is a perspective view of a device embodying the present invention, displaced from its operative position against the stove, which is shown in phantom line.

Turning now in detail to FIGS. 1–4 of the appended drawings, therein illustrated is a device embodying the present invention and consisting of a hood or duct, generally designated by the numeral 10, mounted upon a receptacle, generally designated by the numeral 12. The duct 10 is of generally rectangular cross-sectional configuration, and consists of planar top, bottom, and side walls, 14, 16 and 18, respectively. The bottom wall 16 of the duct 10 has a rectangular opening 20 formed through it, which is disposed intermediate the front end 22 and the back end 24; it is particularly important that the rearward land area 26 be of substantial width (i.e., as measured along the longitudinal axis of the duct), as will be discussed in detail hereinbelow.

Figure 3:
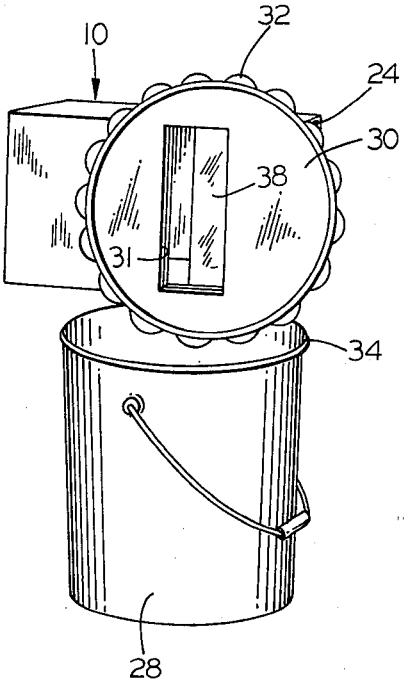
FIG. 3 is a perspective view of the device of the foregoing Figures, drawn to a further enlarged scale and showing the assembled duct and receptacle cover removed from the ash container.

The receptacle 12 consists of a container or pail 28 and a cover or lid 30, which has a flanged circumferential portion 32 for gripping engagement of the rim 34; this construction is, of course, entirely conventional in such a pail. As best seen in FIG. 3, the lid 30 is formed with a rectangular opening 31 corresponding to, and aligned with, the opening 20 in the bottom wall 16 of the duct 10; the assembly is supported upon the pail 28.

A sliding door, generally designated by the numeral 36, is mounted on the bottom wall 16 of the duct 10, in position to close the opening 20 formed therein. The door 36 consists of a panel or plate 38, and an upstanding flange portion 40 by which it can be manipulated.

In use, the device is positioned directly in front of the stove, generally designated by the numeral 42, with the front end 22 of the duct 10 aligned over the fire box opening 44, the stove door 45 being displaced to accommodate the duct. A rake or hoe 46 can then be manipulated through the open back end 24, to draw the collected ash 48 onto the bottom wall 16 and to the openings 20, 31, for discharge into the pail 28. The duct door 36 can thereafter be closed to prevent the escape of ash, and for storage to await the next cleaning operation.

Figure 2:
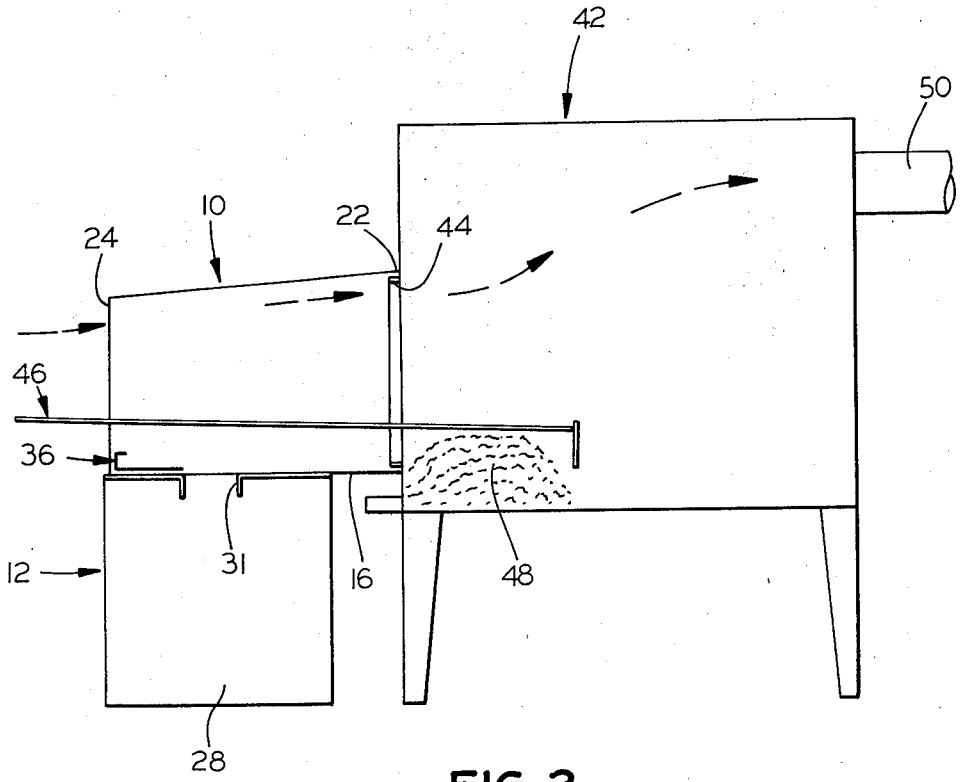
FIG. 2 is a diagrammatical sectional view of the device in operative position against the stove, illustrating the use of a rake or hoe to withdraw accumulated ash therefrom.
Figure 4:
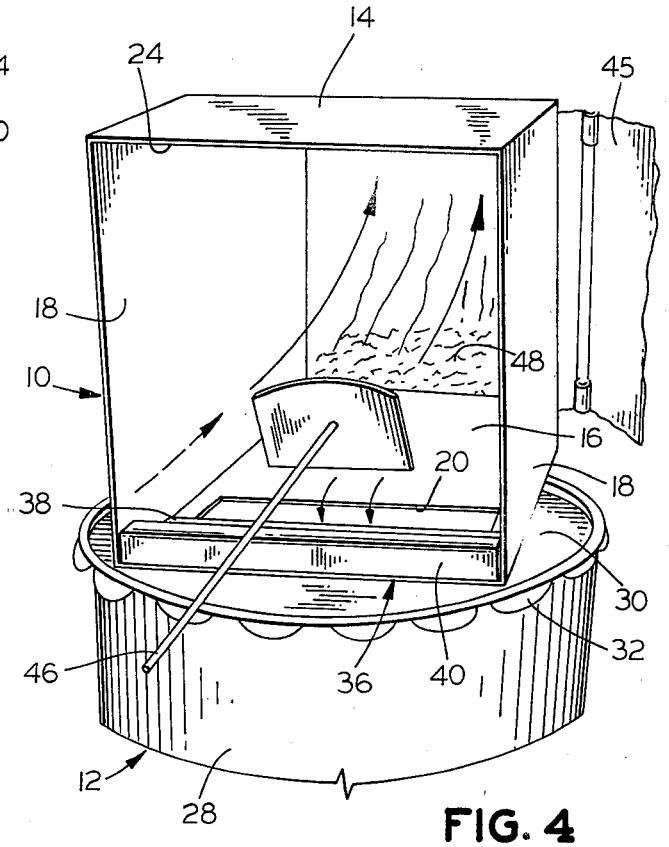
FIG. 4 is a fragmentary perspective view, drawn to a greatly enlarged scale, showing the device of the invention in operative position against the stove opening.

As will be appreciated, during withdrawal of the ash 48, the draft through the stove flue 50 will cause a current of air to flow through the duct 10, as indicated by the arrows in FIG. 2. The location of the opening 20 in the bottom wall 16, within the confines of the duct 10 and spaced from the back end 24 by at least about six inches, will ensure that airborne ash fines are not discharged to the atmosphere, but are instead drawn back into the stove 42, as indicated in FIG. 4.

Figure 6:
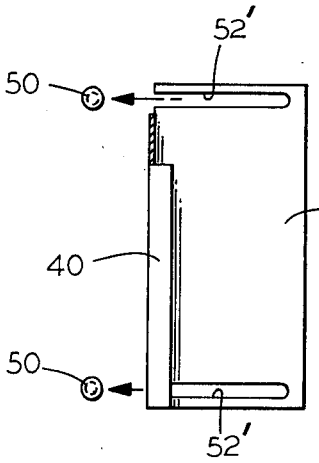
FIG. 6 is a plan view illustrating a slightly modified form of closure plate, drawn to a slightly enlarged scale and having a flange section broken away to show details of construction.
Figure 5:
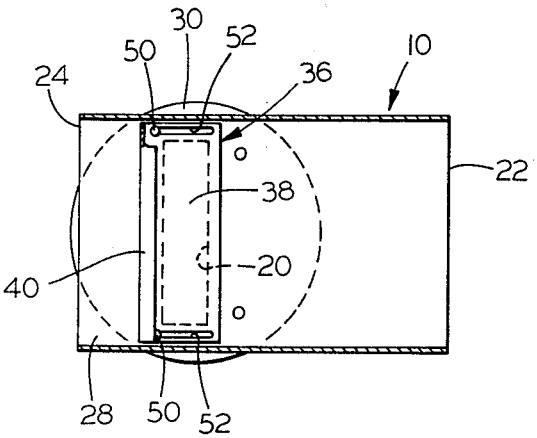
FIG. 5 is a horizontal sectional view through the duct, showing the slide plate in closed position over the bottom wall opening, the flange of closure being broken away to illustrate the attachment means.

In FIGS. 5 and 6, means by which the door 36 can be secured to the bottom wall 16 of the duct 10 are illustrated. Although the two structures differ slightly, in each instance a pair of fasteners 50, having enlarged head portions, are used in cooperation with slots formed in the side margins of the plate 38. In the construction shown in FIG. 5, the fasteners 50 may be rivets which are inserted through the slots 52 and are fixed in appropriate openings in the bottom wall 16; this would, of course, provide a permanent attachment for the door 36 while permitting it to be moved between its open and closed positions, with the rivets 50 riding in the marginal slots 52.

In the embodiment of FIG. 6, the slots 52' are open-ended, permitting the door 36 to be mounted upon the headed fasteners 50 simply by sliding the plate 38 rearwardly thereonto, with the shanks of the fasteners being introduced into the open ends of the slots. The door 36 can thereafter be moved between its alternative positions, but will be restrained against disengagement only in the rearward direction; obviously, it can be dismounted by shifting it forwardly, from beneath the fasteners 50.

Figure 7:
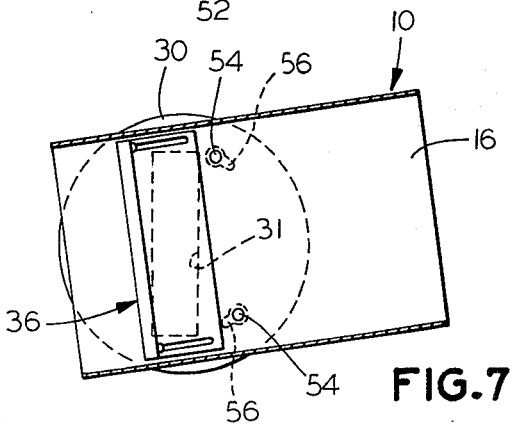
FIG. 7 is a view similar to FIG. 5, showing structure by which the duct is secured to the receptacle lid.

Turning finally to FIG. 7, the means by which the duct 10 is secured to the lid 30 is illustrated, and utilizes a pair of headed depending studs 54 affixed to the bottom of the duct, and cooperating keyhole slots 56 formed into the lid 30. Assembly is effected merely by inserting the enlarged ends of the studs 54 into the circular section of the slots 56, and then rotating one of the members to engage the shafts of the studs within the narrower slot sections.

As will be evident to those skilled in the art, the device will be made of a non-inflammable material, typically steel, and generally the duct will be of sheet metal construction. The size and shape of the front end opening of the duct will be dictated by that of the ash-removal opening of the stove with which the device is to be employed, and hence can have any of a wide variety of configurations. While it is not necessary that an air-tight seal be achieved against the surrounding portion of the stove, the end of the duct should be so configured as to minimize gaps and spaces through which smoke and ash might escape, and thus the contacting edge of the duct should be conformed to the corresponding part of the stove. As will be appreciated by those skilled in the art, numerous other modifications may be made to the device without departing from the concepts of the invention.

Thus, it can be seen that the present invention provides a substantially portable device for removing ash from a stove or the like, which device is relatively simple and inexpensive to manufacture, and is nevertheless highly effective in minimizing the amounts of fines and dust that are released during ash-removal operations. More specifically, the device of the invention is so designed as to take advantage of the draft of the stove with which it is used, to substantially prevent the escape of airborne ash to the environs.

Having thus described the invention, what is claimed is:

1. A substantially portable device for use in removing ash from a stove or the like without need for any attachment thereto, the stove having an ash-removal opening through which a draft of air flows during normal operation, said device comprising:

a duct having an open front end dimensioned and configured to substantially enclose the ash-removal opening of the stove for direct, close-fitting positioning thereagainst, and an open back end for free air flow and ash removal access, the bottom wall portion of said duct having an opening therethrough intermediate said front and back ends and entirely within the confines of said duct, said device also including a displaceable door for covering said bottom wall portion opening, and means for securing said duct to an ash receptacle disposed therebeneath to permit free-standing positioning of said device in front of the stove, said duct providing an extension from the stove opening when aligned generally horizontally therewith and positioned thereagainst, whereby ash can be withdrawn from the stove and guided to said opening, through which it can fall into the underlying receptacle, and whereby the draft of the stove will cause air to flow into said back end and to sweep across said opening, to prevent the escape of any substantial amount of airborne ash fines or dust.

2. The device of claim 1 wherein said bottom wall portion is substantially planar, and wherein said opening therethrough is spaced from said back end a distance sufficient to provide a section of said bottom wall portion between said opening and said back end that is at least about six inches wide.

3. The device of claim 1 wherein the cross-sectional configuration of said duct and the opening of the stove are generally rectangular, and wherein said back end is entirely open.

4. The device of claim 1 wherein said displaceable door comprises a panel that is slideably mounted on said bottom wall portion of said duct for movement between a closed position, over said opening, and an open position, displaced therefrom toward said back end of said duct.

5. The device of claim 1 additionally including a receptacle comprising an upwardly opening container disposed beneath said duct, said receptacle having means for disengageable attachment to said securing means of said duct.

6. The device of claim 5 wherein said receptacle is dimensioned and configured to provide underlying support for said duct, with said duct in alignment with the stove opening.

7. The device of claim 5 wherein said receptacle additionally includes a cover for said container, said cover being attached to said securing means of said duct and having a portion thereon for gripping engagement with the rim of said container.

* * * * *